US005857243A

United States Patent [19]

Champion

[11] Patent Number: 5,857,243

[45] Date of Patent: Jan. 12, 1999

[54] CLASP WITH UNFOLDING BUCKLE

[75] Inventor: Michel Champion, Courgenay, Switzerland

[73] Assignee: SMH Management Services AG, Biel, Switzerland

[21] Appl. No.: 955,364

[22] Filed: Oct. 21, 1997

[30] Foreign Application Priority Data

Nov. 6, 1996 [FR] France ..... 96 13527
Nov. 6, 1996 [FR] France ..... 96 13529

[51] Int. Cl.[6] ..... A44B 11/00; A44C 5/00

[52] U.S. Cl. ..... 24/71 J; 24/68 J; 24/70 J; 24/265 WS

[58] Field of Search ..... 24/71 J, 68 J, 24/69 J, 70 J, 616, 265 WS

[56] References Cited

U.S. PATENT DOCUMENTS

| | | | |
|---|---|---|---|
| 1,741,421 | 12/1929 | Kraemer | 24/71 J |
| 1,809,278 | 6/1931 | Kestenman | 24/71 J |
| 2,532,840 | 12/1950 | Gaun | 24/71 J |
| 3,863,299 | 2/1975 | Hocq | 24/71 J |
| 4,382,318 | 5/1983 | Takimoto | 24/71 J |
| 4,928,359 | 5/1990 | Gagnebin | 24/71 J |

FOREIGN PATENT DOCUMENTS

| | | |
|---|---|---|
| 353 567 | 4/1961 | France . |
| 593 648 | 8/1977 | France . |
| 2 442 605 | 6/1980 | France . |
| 663 522 | 12/1987 | France . |
| 2 615 368 | 11/1988 | France . |
| 671 499 | 9/1989 | France . |
| 2 735 335 | 12/1996 | France . |

*Primary Examiner*—Victor N. Sakran
*Attorney, Agent, or Firm*—Griffin, Butler, Whisenhunt & Szipl, LLP

[57] ABSTRACT

The bracelet clasp is of the type having an unfolding buckle including a base strip (1) onto which at least a first pivoting strip (2) is capable of folding down. A locking device blocks the strips one onto the other.

The locking device consists in two tongues (4, 5) raised from the base strip (1) and a fork having the shape of a tuning fork made in the pivoting strip (2), this fork having two branches (7, 8) whose ends (9, 10) are bent, each of said ends being arranged to snap lock onto one of the tongues raised from the base strip when the clasp is in a closed position.

The clasp can be advantageously used in connection with a wristwatch bracelet.

7 Claims, 5 Drawing Sheets

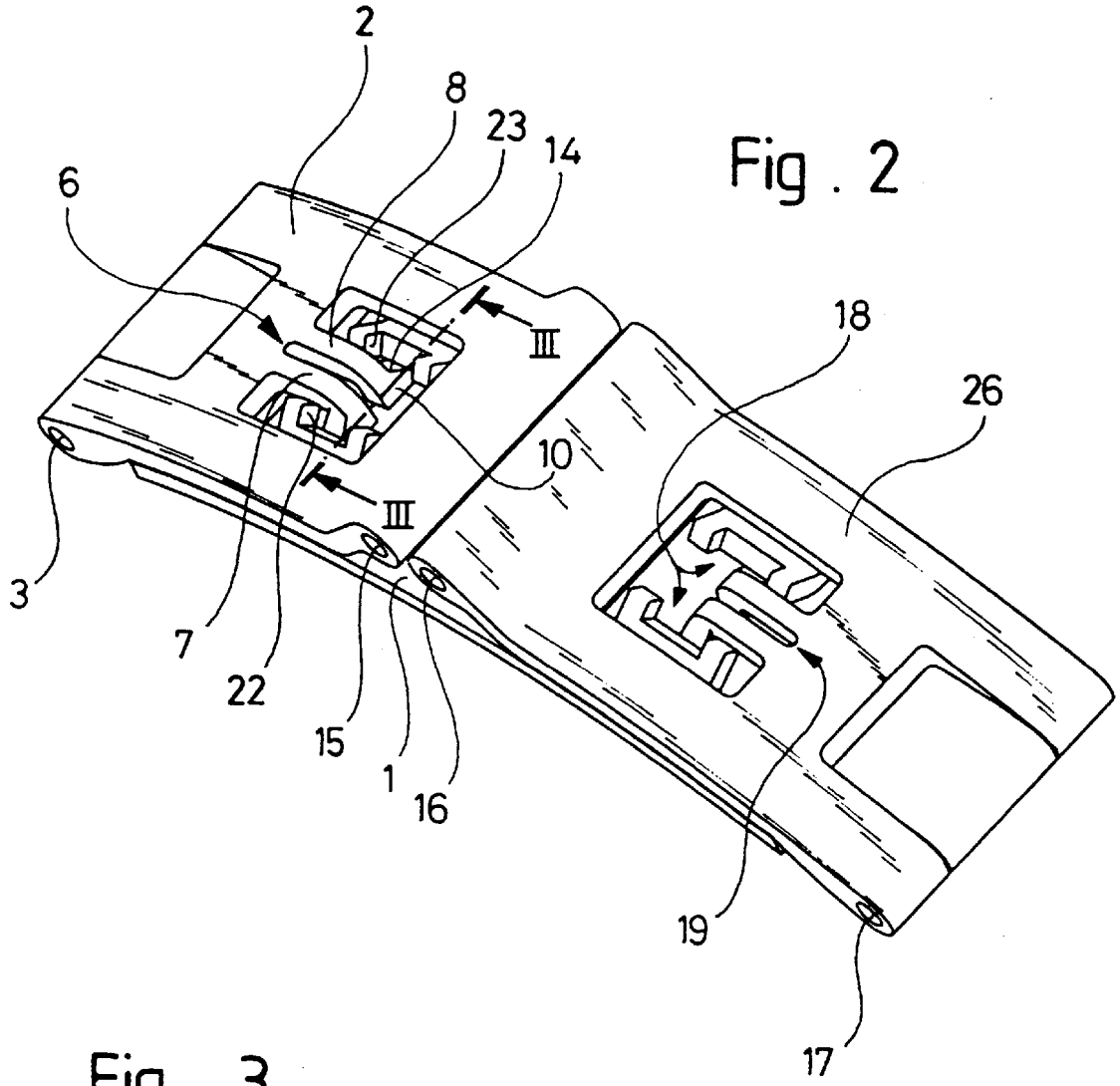
Fig . 2
Fig . 3
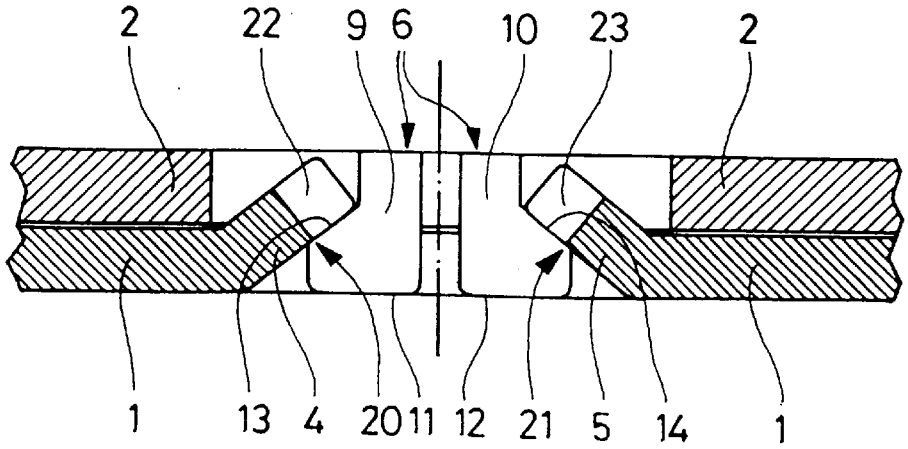

CLASP WITH UNFOLDING BUCKLE

The present invention relates to a clasp of the type with an unfolding buckle including a base strip onto which at least one pivoting strip is capable of folding down, said strips being attached to each other by one of their ends by means of a hinge, these strips including a snap fitting device allowing them to lock onto each other in a closed position.

A clasp fitting the definition given hereinbefore has already been proposed several times.

The document CH-A-663 522 discloses a clasp with an unfolding buckle including a base strip provided with an elongated opening, a pivoting strip provided with two elongated horns extending in the direction of the opening in the base strip being capable of folding down onto said base strip. In the clasp's closed position, the two horns of the pivoting strip are forcibly engaged in the opening of the base strip so that this system forms a snap fastening device. Since the opening and the horns are directed in the longitudinal direction of the clasp, a movement which would tend to fold the clasp lengthways does not lead to inadvertent opening of said clasp, there being however a risk of such inadvertent opening occurring if the horns and the opening were directed in a direction perpendicular to the direction of the strips.

Similar devices are also disclosed in the documents CH-A-593 648, CH-A-353 567 and CH-A-671 499.

The clasp disclosed in the document FR-A-2 735 335 also includes a snap fitting device wherein a first tongue is raised from the base strip and a second tongue is raised from the pivoting strip, these two tongues being situated, in a closed position, back to back and head to tail. This document envisages the use of a second pivoting strip whose attachment may be achieved either by snap fitting as described hereinbefore, or via a push button using the same base strip. Thus, the base strip is multi-purpose in the sense that either a pivoting strip fitted with a tongue, or a pivoting strip fitted with a manually operated push button may be mounted thereon.

All these systems have the drawback of wearing out rapidly and no longer assuring proper fastening of the clasp after a relatively small number of opening and closing movements. This is due essentially to the very short length by which the horns protrude, which results in extremely reduced bending amplitude, and thus to high snap fitting force and, consequently, to rapid wear of the system.

In order to overcome this drawback, the clasp of the present invention is provided with a snap fitting device including two tongues raised from the base strip and facing each other in a direction perpendicular to the longitudinal direction of the clasp and a fork in the shape of a tuning fork made in the pivoting strip, this fork being directed in the longitudinal direction of the clasp and having two branches whose ends are bent, each of said ends being arranged to snap lock onto one of the tongues raised from the base strip when the clasp is in the closed position.

The invention will be explained now with reference to the following description and the drawing which illustrates it by way of example and in which:

FIG. 2 is a perspective view of the clasp of the invention in a closed position;

FIG. 3 is a cross-section along the line III—III of FIG. 2;

Figure 1:
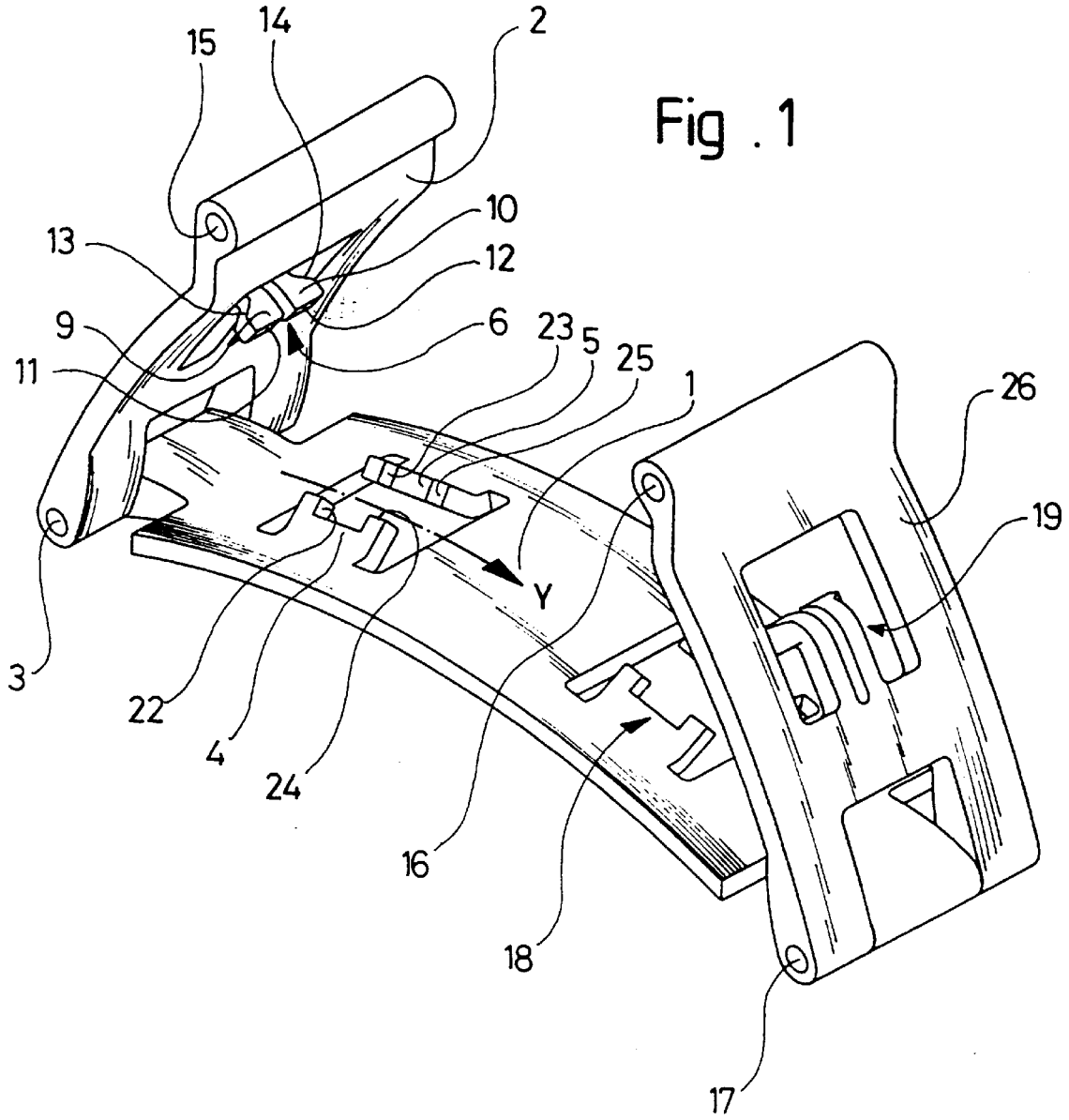
FIG. 1 is a perspective view of the clasp of the invention in an open position.

As is shown in FIG. 1, the bracelet clasp is of the unfolding type. This clasp comprises a base strip 1 onto which at least one pivoting strip 2 is capable of folding down. Strips 1 and 2 are attached to each other by one of their ends by means of a hinge 3. This hinge is made, in the simplest manner, with a base extending through holes provided in the end of strip 1 and 2.

As is shown by FIG. 1, the clasp may include a second pivoting strip 26 capable of folding down onto base strip 1. In this case, this second strip is attached to the other end of base strip 1 by means of a second hinge 17. Although not explicitly shown by FIG. 1, a first strand of the bracelet is attached to pivoting strip 2 by means of a bar passing through hole 15, whereas a second strand of the bracelet is attached to pivoting strip 26 by means of a bar passing through hole 16. Base strip 1 and pivoting strips 2 and 26 include a double snap fitting device which allows the pivoting strips to lock onto the base strip in the clasp's closed position.

The clasp may include only a single pivoting strip 2. In this case the first bracelet strand is attached to the other end of pivoting strip 2 by a bar passing through hole 15 and the second bracelet strand is attached to the other end of base strip 1 at the place represented by hinge 17. It will be understood that in the case of a clasp having a single pivoting strip, the latter will be extended to have an approximately equal length to the length of the base strip.

The main subject of the invention, namely the snap fitting device or snap locking device, will now be described.

As FIG. 1 shows, two tongues 4 and 5 are raised from base strip 1. These tongues are arranged so as to face each other in a direction perpendicular to the longitudinal direction of the clasp, this longitudinal direction being marked by the letter Y. FIG. 2 shows that a fork 6 in the shape of a tuning fork is made in pivoting strip 2, this fork being directed in the longitudinal direction of the clasp. By a fork in the shape of a tuning fork, one means here an element having two branches 7 and 8 of great length and connected by a bridge, which is not the case of the horns cited in the prior art, which are essentially very short and resemble more a U than a tuning fork. The ends 9 and 10 of branches 7 and 8 of fork 6 are bent and arranged so as to snap lock onto one of the tongues raised from the base strip when the clasp is in a closed position.

According to a particular embodiment of the invention which is shown in the drawing, bent ends 9 and 10 of branches 7 and 8 are each provided with a flared portion 11 and 12. As is clear from FIG. 1, each flared portion is provided with an inclined plane 13 and 14, this inclined plane co-operating with corresponding tongue 4 and 5 raised from base strip 1 to snap lock pivoting strip 2 onto said base strip 1.

The snap fitting is particularly well shown in FIG. 3 which is a cross-section along the line III—III of FIG. 2. FIG. 3 shows in cross-section base strip 1 fitted with its raised tongues 4 and 5. Pivoting strip 2, whose branches 7 and 8 of its fork 6 are represented by ends 9 and 10 of the branches, is also shown in cross-section in FIG. 3. Ends 9 and 10 are provided with flared portions 11 and 12 each having an inclined plane 13 and 14. When the clasp is in a closed position, FIG. 3 shows that inclined planes 13 and 14 rest under tongues 4 and 5 at the place marked by an arrow 20 and 21 to lock the clasp. In order to open the clasp, a force is exerted upwards on pivoting strip 2. At this moment, inclined planes 13 and 14 slide underneath tongues 4 and 5 causing ends 9 and 10 of branches 7 and 8 to move towards each other to release pivoting strip 2 from base strip 1. In order to close the clasp, the two strips are moved towards each other until flared portions 11 and 12 are in contact with tongues 4 and 5. At this moment, a pressure on strip 2 causes a bending movement of branches 7 and 8, which move towards each other until inclined planes 13 and 14 are caught underneath tongues 4 and 5.

The Figures show that tongues 4 and 5 raised from base strip 1 and fork 6 made in pivoting strip 2 are advantageously made of one piece with the strips of which they form part. This may be implemented by simple stamping, then folding. Any additional parts, which are fragile to use and expensive are thus avoided.

Base strip 1 and pivoting strip 2 may advantageously be truncated in strip-shaped profiles, which are more rigid than bent sheet metal and easily able to be deformed. Metal injection moulding (MIM) could be also envisaged for the manufacture of said parts.

FIGS. 1 and 2 show that in the event that the clasp includes two pivoting strips, these first and second strips are provided with a snap fitting device made according to the invention.

One may however imagine the case in which one of the pivoting strips is provided with a push button locking device, the other of these strips being provided with a snap fitting device according to the invention. This case is illustrated in FIGS. 4 to 7. In these last Figures, pivoting strip 2 of FIGS. 1 and 2 is replaced by pivoting strip 30. It is to be noted, however, that in both cases, a single base strip 1 is used, as is clearly seen in FIGS. 1 and 4.

FIGS. 4 to 7 thus show that, with pivoting strip 30, base strip 1 forms a push-button locking device. In order to do this, the push-button locking device includes a unit 31 mounted so as to pivot on the other end of pivoting strip 30 by means of a hinge 32. This unit 31 includes a frame 33 on which two push-buttons 34 and 35 slide, each returned by a spring 36 and 37. Each of these push-buttons 34 and 35 carries a hook 38 and 39 each cut in the shape of a T. The horizontal bar of the T is capable of engaging underneath lugs 22, 24 and 23, 25 of tongues 4 and 5 raised from base strip 1 to lock the clasp.

Figure 6:
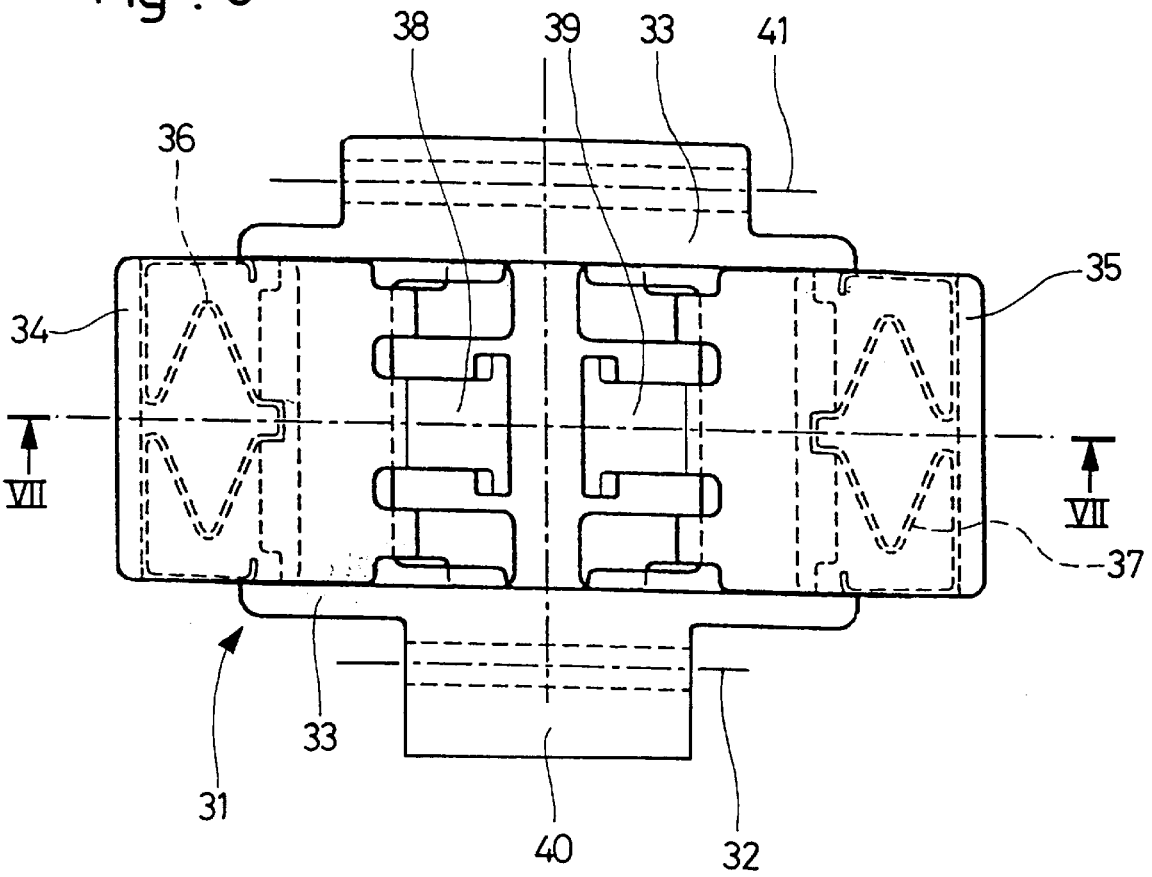
FIG. 6 is a top view of the push button device shown in FIG. 5.
Figure 7:
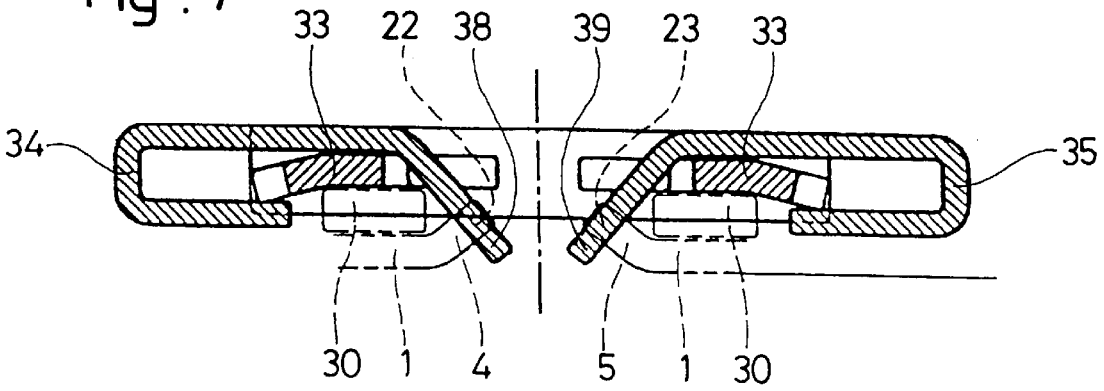
FIG. 7 is a cross-section along the line VII—VII of FIG. 6.

This device, seen in perspective in FIGS. 4 and 5 will be explained now in a more detailed manner with reference to plane FIG. 6 and cross-section FIG. 7.

Frame 33 pivots on pivoting strip 30 by means of hinge 32. This frame 33 carries two push-buttons 34 and 35 which slide thereon and are each returned by a spring 36, 37. Push-button 34 includes a hook 38 in the shape of a T whose horizontal bar is held underneath lugs 22 and 24 of tongue 5. In a similar manner, push button 35 comprises a hook 39 having a T shape and whose horizontal bar is held underneath lugs 23 and 25 of tongue 5. In order to close the device, pivoting strip 30 and unit 31 are moved towards base strip 1. By pressing on all of these elements, the horizontal bars of hooks 38 and 39 are slid, against the return force of springs 36 and 37, along lugs 22, 24 and 23, 25 respectively until these bars are held underneath the lugs. Henceforth the clasp is locked and no upwards force exerted on pivoting strip 30 is capable of opening the clasp, this opening only being able to be produced if the push-buttons are pressed to release hooks 38 and 39 from lugs 22, 24 and 23, 25.

Figure 4:
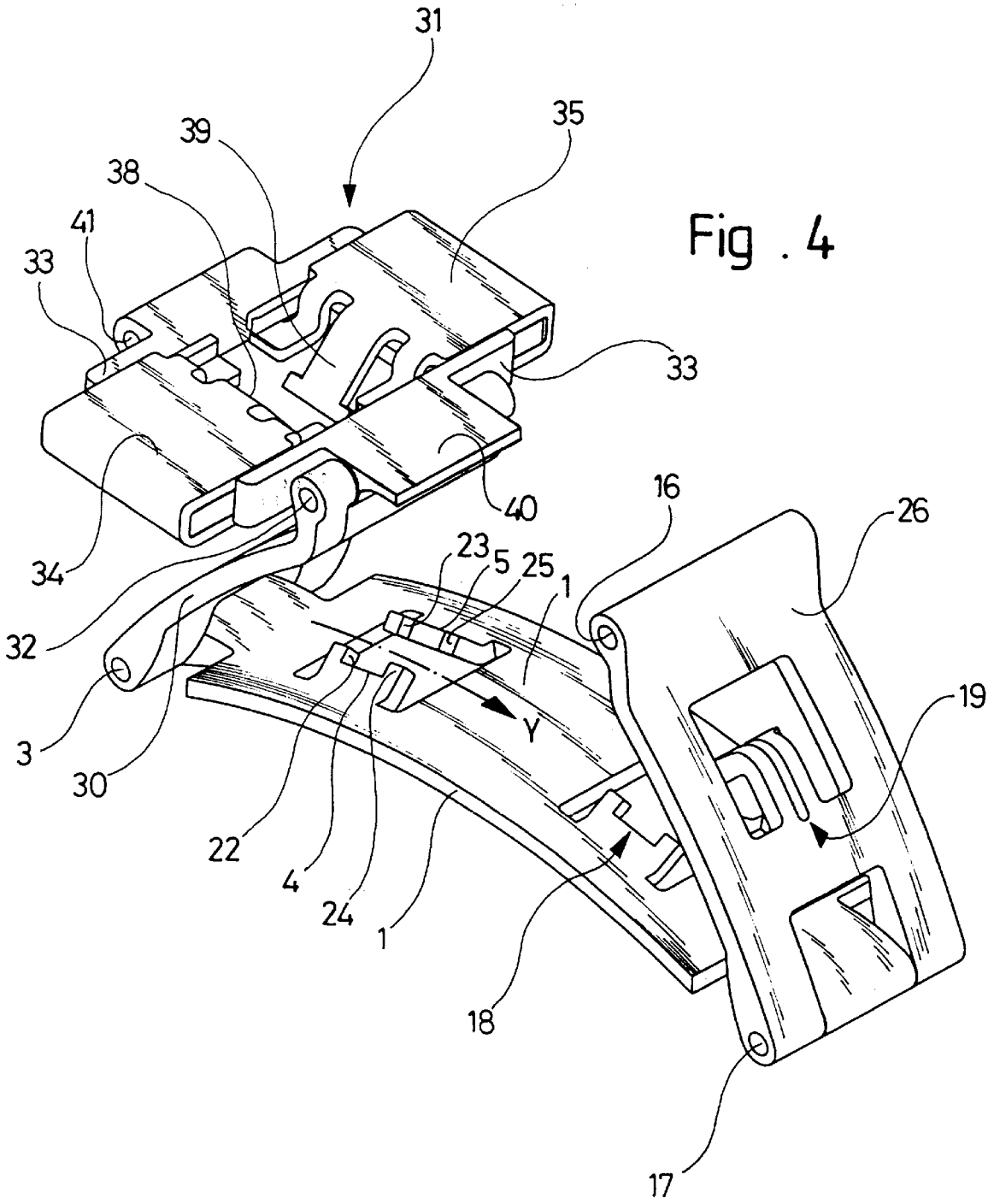
FIG. 4 is a perspective view of the clasp of the invention in an open position, a pivoting strip of this clasp having a push button locking device.
Figure 5:
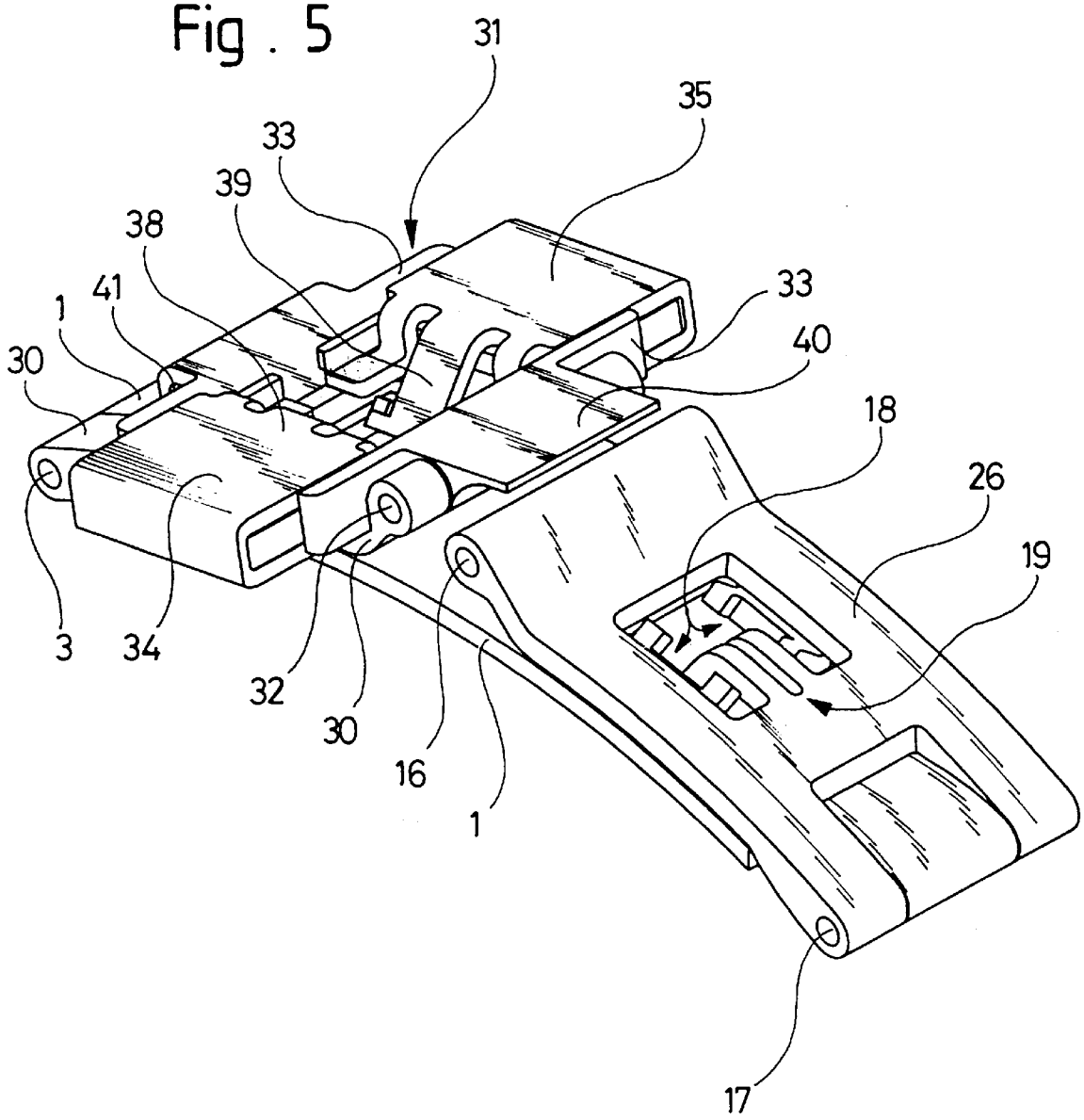
FIG. 5 is a perspective view of the clasp of FIG. 4 shown in a closed position.

In the case of the embodiment shown in FIGS. 4 and 5, a first bracelet strand is attached to unit 31 by means of a bar passing through hole 41 of frame 33, whereas a second bracelet strand is attached to pivoting strip 26 by means of a bar passing through hole 16. Here base strip 1 receives a first pivoting strip 30 fitted with a push-button device and a second pivoting strip 26 fitted with a snap fitting device. To avoid strip 26 being able to be opened only when the clasp is in a closed position, element 31 has been fitted with a roof 40 which covers the end of strip 26.

It can be seen that via very simple means (lifting and replacing a simple bar) a clasp locked by snap fitting can be transformed into a clasp locked by a push-button. The safety of the clasp closure can be increased while preserving in each case the same base strip.

What is claimed is:

1. A bracelet clasp of the type with an unfolding buckle including a base strip onto which at least a first pivoting strip is capable of folding down, said strips being attached to each other by one of their ends by means of a hinge, said strips including a snap fitting device allowing them to lock onto each other in a closed position, wherein the snap fitting device includes two tongues raised from the base strip and facing each other in a direction perpendicular to the longitudinal direction of the clasp and a fork in the shape of a tuning fork made in the pivoting strip, this fork being directed in the longitudinal direction of the clasp and having two branches whose ends are bent, each of said ends being arranged to snap lock onto one of the tongues raised from the base strip when the clasp is in a closed position.

2. A clasp according to claim 1, wherein the bent ends of the two branches are each provided with a flared portion onto which an inclined plane is arranged, said inclined plane co-operating with the corresponding tongue raised from the base strip to snap lock the pivoting strip onto said base strip.

3. A clasp according to claim 1, wherein the tongues raised from the base strip and the fork made in the pivoting strip are integral with the strips of which they form part.

4. A clasp according to claim 1, wherein the base strip and the pivoting strip are cut into strip-shaped profiles.

5. A clasp according to claim 1, wherein a second pivoting strip is capable of folding down onto the base strip.

6. A clasp according to claim 5, wherein the second pivoting strip is made in the same manner as the snap fitting device fitting the first pivoting strip.

7. A clasp according to claim 5, wherein the second pivoting strip includes a push-button locking device, said device comprising a unit mounted so as to pivot on the other end of the pivoting strip by means of a hinge, said unit including a frame on which two push-buttons slide, each returned by a spring, these push-buttons each including a hook in the shape of a T the horizontal part of which is capable of engaging underneath the lugs of the tongues raised from the base strip to lock the clasp.

* * * * *